United States Patent [19]

Groothoff et al.

[11] Patent Number: 4,823,460

[45] Date of Patent: Apr. 25, 1989

[54] METHOD OF MANUFACTURING AN ELECTROMAGNETIC DEFLECTION UNIT

[75] Inventors: Adriaan J. Groothoff; Albertus A. S. Sluyterman; Dik R. Overdijk; Jacob Van Maastricht, all of Eindhoven, Netherlands

[73] Assignee: U.S. Philips Corp., New York, N.Y.

[21] Appl. No.: 126,384

[22] Filed: Nov. 30, 1987

[30] Foreign Application Priority Data

Dec. 1, 1986 [NL] Netherlands ..... 8603056

[51] Int. Cl.[4] ..... H01F 7/06

[52] U.S. Cl. ..... 29/605; 140/92.2; 336/192

[58] Field of Search ..... 29/605; 336/192; 140/92.2

[56] References Cited

U.S. PATENT DOCUMENTS

| | | | |
|---|---|---|---|
| 3,086,562 | 4/1963 | Prize | 140/92.2 |
| 3,388,363 | 6/1968 | Novick | 29/605 X |
| 3,409,980 | 11/1968 | Lawless et al. | 29/605 |
| 3,445,797 | 5/1969 | Otto | 336/192 |
| 3,507,039 | 4/1970 | Craige | 29/605 |
| 3,518,590 | 6/1970 | Gross et al. | 29/605 X |

*Primary Examiner*—Carl E. Hall

*Attorney, Agent, or Firm*—F. Brice Faller

[57] ABSTRACT

A pair of saddle-shaped deflection coils are wound in a jig and are then assembled with other components. During winding the coil an electrically insulating support having electrically conductive connection points for the coil terminators is used, the terminators being connected to the connection points after winding.

8 Claims, 1 Drawing Sheet

METHOD OF MANUFACTURING AN ELECTROMAGNETIC DEFLECTION UNIT

The invention relates to a method of manufacturing an electromagnetic deflection unit for a cathode ray tube, which deflection unit comprises at least one pair of saddle-shaped deflection coils. Each coil is wound in a jig and a current is then passed through the coil so that turns of the coil are bonded together. Coils thus obtained are combined with other parts of the deflection unit.

The invention also relates to a cathode ray tube comprising an electromagnetic deflection unit manufactured according to the method of the invention for deflecting at least one electron beam, which deflection unit comprises at least one pair of saddle-shaped deflection coils which are combined with other parts of the deflection unit.

A method of the kind mentioned in the opening paragraph is disclosed in U.S. Pat. No. 3,086,562. The saddle-shaped coils which are wound in a jig in known manner have coil terminators which, when the coils leave the winding machine, assume an arbitrary position. The further processing of the coils is then done manually because a mechanised manufacture of the deflection units causes great problems due to the arbitrary position of the coil terminators.

SUMMARY OF THE INVENTION

The invention recognizes that mechanised manufacture is readily possible when the position of the coil terminators is fixed during the winding process of the coils.

Prior to winding a respective saddle-shaped coil, an electrically insulating support having connectors for coil terminators is provided in the jig and the coil is then wound. The coil terminators are connected to the connection points and after the passage of current the coil with the support is taken out of the jig as one assembly.

By winding the coil on the support, the coil terminators can be connected to the connectors in a mechanised manufacture in a simple manner so that the position of the coil terminators is accurately fixed.

In an embodiment of the method, the connectors are electrically conductive and the coil terminators are led over the connctors, lugs of which are bent over the coil terminators and are then welded. As a result of this, not only is the position of the coil terminators accurately fixed but the connection of the coil terminators with the connectors also provides the basis for the further processing of the coil which can be mechanised in a simple manner.

In a further embodiment welding is achieved by means of a sandwich weld. It has been found in practice that the transition resistance between coil terminator and the electrically conductive connector in a sandwich weld in which the coil terminator is connected to the connector by heating two sides, is sufficiently small.

In a still further embodiment a connection block with pins fitting in sockets which form part of the connectors is used for connecting the saddle-shaped coil to other coils and to other connections to the exterior. Several coils which are to be connected together to obtain the desired deflection fields in various manners are present in a deflection unit. As a result of the embodiment described, said connection can simply be carried out and connections to the exterior can simultaneously be obtained.

According to an embodiment of the method of the invention a part of the support, which part is embedded in the coil and present away from the connection points is given a substantially flat shape. The embedded part of the support may comprise a projection which assists in locking the support in the coil.

Conventionally, a current is passed through a wound saddle-shaped coil as a result of which the turns which comprise a so-called thermo-bonding layer, are bonded together. For further assembly the coil is then placed in a hood. However, said placing of the coil in the hood is not accurately reproducible.

When the support is a hood provided in the jig and the coil is then wound, a simple assembly which can be combined accurately is obtained, for example, by giving the hood the desired shape to support the coil and reference surfaces so that various coils supported by their hoods can be assembled together accurately after winding. Since furthermore upon current passage the turns of the coil are bonded together and to the support, an accurately reproducible rigid locking is obtained between the support and the coil.

DETAILED DESCRIPTION OF THE PREFERRED EMBODIMENT

Figure 1:
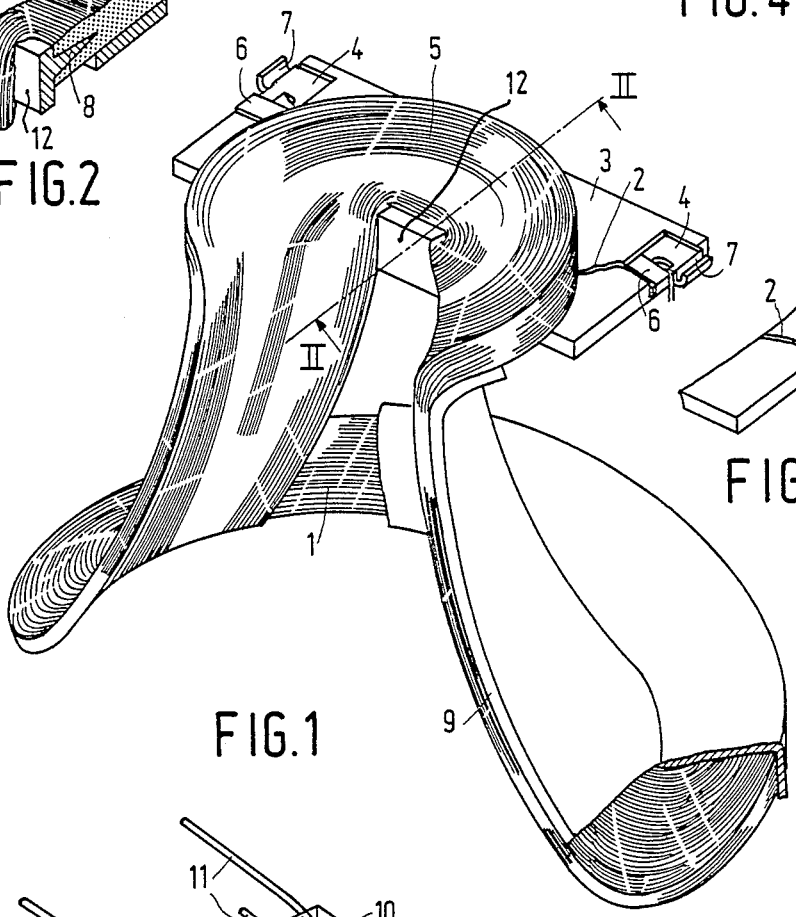
FIG. 1 is a diagrammatic perspective of a part of a deflection unit in a stage of its manufacture.

Referring to FIG. 1, an electrically insulating support 3 having electrically conductive connectors 4 for coil terminators 2 is provided in the jig after which the coil 1 is wound. The coil terminators 2 are connected to the connectors 4 and after current passage through the turns of the coil 1, which turns comprise a thermo-bonding layer, the coil 1 with the support 3 is taken out of the jig as one assembly.

Figure 3:
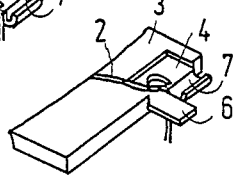
FIG. 3 is a diagrammatic perspective view of a detail of the deflection unit of FIG. 1 in an earlier stage of the manufacture.

The connection can be mechanised in a simple manner. The coil terminators 2 are led over the connection points 4, lugs 6 of which, as shown in FIG. 3, are bent over the coil terminators 2 and are welded. Since current is applied to the coil terminators 2 via the connectors 4, the transition resistance between the connectors 4 and the coil terminators should be as small as possible. This can be achieved by a sandwich weld in which the coil terminators are heated from two sides.

Figure 2:
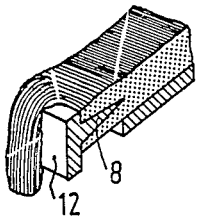
FIG. 2 is a section view taken on the line II—II of FIG. 1.
Figure 5:
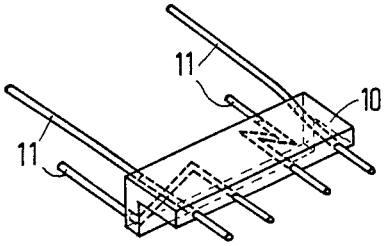
FIG. 5 is a perspective of a connection block with pins used in the deflection unit.

Further connections, for example, interconnections to other coils of the deflection unit and to connections to the exterior are obtained by means of a connection block 10 with pins 11 as shown in FIG. 5 fitting in sockets 7 which form part of the connectors 4. A part 12 of the support 3 situated away from the connection points 4 and embedded in the coil 1 is given a substantially flat shape. A projection 8 may be present at the embedded part 12 of the support 3 which assists in locking of the support 3 in the coil 1 as is shown in FIG. 2.

In a conventional manner a current is passed through the wound saddle-shaped coil 1 so that the turns are bonded together and thus the coil becomes self-supporting, after which the coil 1 is placed in a hood. Preferably a hood 9 is used as a support (of which a part is shown in FIG. 1 and of which the support 3 shown forms part) after which a current is passed through the coil 1 so that the turns 5 of the coil 1 are bonded together and to the hood 9 via the thermo-bonding layer. For this purpose the hood 9 should be manufactured of a material which permits said bonding. An example of a suitable material is a synthetic resin, for example polyphenylene oxide (PPO) with modified acryl-butadiene-styrene (ABS). Coil 1 and hood 9 are then taken out of the jig as one assembly after which further assembly may be carried out.

When two of the saddle-shaped coils manufactured according to the invention are placed opposite to one another to form a deflection unit, an electrical connection between the two coils is obtained in a simple manner by choosing the length of the pins 11 of the connection block 10 (see FIG. 5) in such a manner that the sockets at the connection points of the respective coils are electrically connected together when the pins of the connection block 10 are inserted into the sockets.

Figure 4:
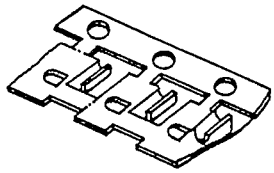
FIG. 4 is a diagrammatic perspective view of an auxiliary means for carrying out the method.

The invention is not restricted to the examples described. In the manner described, for example, saddle-shaped field deflection coils may also be manufactured. In a mechanised manufacture the support with connection points can be obtained starting from a synthetic resin support, optionally as a part of a hood, and a strip of connection points (see FIG. 4) which are connected to the synthetic resin support in a conventional manner, for example, by inserting or insert-moulding.

The saddle-shaped line deflection coils may also be combined with toroidally wound field deflection coils.

It will be obvious that many variations of the method described are possible to those skilled in the art without departing from the scope of this invention.

What is claimed is:

1. A method of manufacturing an electromagnetic deflection unit for a cathode ray tube, which deflection unit comprises at least one pair of saddle-shaped deflection coils, said method comprising the following steps:

providing a jig for winding each saddle-shaped coil, providing an electrically insulating support in the jig, said support carrying electrically conductive connectors for the coil terminators, winding a saddle-shaped coil in the jig, said coil comprising a plurality of turns and a pair of coil terminators, connecting the coil terminators to the connectors, passing a current through the coil so that turns of said coil are bonded together, and then removing the coil and the support from the jig as one assembly.

2. A method as claimed in claim 1, characterized in that the coil terminators are led over the connection points, lugs of which are bent over the coil terminators and are then welded thereto.

3. A method as claimed in claim 2, characterized in that welding is carried out by means of a sandwich weld.

4. A method as claimed in claim 1, characterized in that for the interconnection of the saddle-shaped coils and to connections to the exterior a connection block with pins fitting in sockets is used which form part of the connection point.

5. A method as claimed in claim 1, characterized in that a part of the support situated away from the connection point, which part is embedded in the coil, is given a substantially flat shape.

6. A method as claimed in claim 5, characterized in that a projection for assisting locking of the support in the coil is provided on the embedded part of the support.

7. A method as claimed in claim 1, characterized in that a hood is used as the support.

8. A method as claimed in claim 1, characterized in that the turns of the coil are bonded together and to the support by current passage.

* * * * *